US009339837B2

(12) United States Patent
Tench

(10) Patent No.: US 9,339,837 B2
(45) Date of Patent: May 17, 2016

(54) MISTING AND ATOMIZATION SYSTEMS AND METHODS

(71) Applicant: Theodore Tench, Jerusalem (IL)

(72) Inventor: Theodore Tench, Jerusalem (IL)

( * ) Notice: Subject to any disclaimer, the term of this patent is extended or adjusted under 35 U.S.C. 154(b) by 0 days.

(21) Appl. No.: 14/301,466

(22) Filed: Jun. 11, 2014

(65) Prior Publication Data

US 2014/0367492 A1 Dec. 18, 2014

Related U.S. Application Data

(60) Provisional application No. 61/835,529, filed on Jun. 14, 2013.

(51) Int. Cl.

| | |
|---|---|
| ***B05B 1/34*** | (2006.01) |
| ***B05B 17/00*** | (2006.01) |
| ***B05B 17/06*** | (2006.01) |
| ***B05B 3/08*** | (2006.01) |

(52) U.S. Cl.

CPC ..... *B05B 17/0638* (2013.01); *B05B 3/082* (2013.01); *B05B 17/0653* (2013.01)

(58) Field of Classification Search

CPC ..... B05B 3/1035; B05B 3/1042; B05B 17/0653; B05B 17/068

USPC ..... 239/380–389

See application file for complete search history.

(56) References Cited

U.S. PATENT DOCUMENTS

| | | | | |
|---|---|---|---|---|
| 629,513 | A | 7/1899 | Liebscher | |
| 2,199,093 | A | 4/1940 | Wolfenden | |
| 2,250,340 | A | 7/1941 | Wolfenden | |
| 2,368,742 | A | 2/1945 | Brend | |
| 2,730,738 | A | 1/1956 | Humes | |
| 2,763,510 | A | 9/1956 | Di Nicola | |
| 2,865,325 | A | 12/1958 | Leston et al. | |
| 2,876,039 | A | 3/1959 | Vogdt | |
| 2,986,337 | A | 5/1961 | Clare | |
| 4,040,385 | A | 8/1977 | Tost | |
| 4,313,974 | A | 2/1982 | Greve et al. | |
| 5,314,119 | A * | 5/1994 | Watt | 239/220 |
| 5,842,642 | A | 12/1998 | Plasko | |
| 5,915,627 | A | 6/1999 | Plasko | |
| 6,230,984 | B1 * | 5/2001 | Jager | 239/225.1 |
| 6,382,524 | B1 | 5/2002 | James | |
| 6,692,570 | B2 | 2/2004 | Cottier et al. | |
| 6,896,200 | B2 | 5/2005 | Dobson | |
| 7,429,297 | B1 | 9/2008 | Chandler | |
| 7,721,976 | B2 * | 5/2010 | Nolte et al. | 239/224 |

(Continued)

OTHER PUBLICATIONS

International Search Report and Written Opinion for International Application No. PCT/US2015/034809, issued Aug. 25, 2015, Applicant, Theodore Tench (12 pages).

*Primary Examiner* — Davis Hwu

(74) *Attorney, Agent, or Firm* — Mark M. Friedman

(57) ABSTRACT

An atomization device including a contact plate including a plurality of capillary openings, a liquid source in fluid communication with the contact plate, and a brush including a plurality of filaments. As the brush rotates a first radial direction, the filaments adhere small amounts of liquid from within the capillary openings, flex when in contact with the contact plate, and release when contact is broken with the contact plate to project liquid from the filaments as they oscillate. A portion of the contact plate includes a spirally curved surface with which the filaments contact, wherein the radius decreases along a path following the first radial direction.

20 Claims, 4 Drawing Sheets

(56) References Cited

U.S. PATENT DOCUMENTS 8,960,568 B2 * 2/2015 Chen et al. ..... 239/221
2003/0178505 A1 * 9/2003 Binder et al. ..... 239/225.1
2010/0301139 A1 * 12/2010 Achord ..... 239/380

* cited by examiner

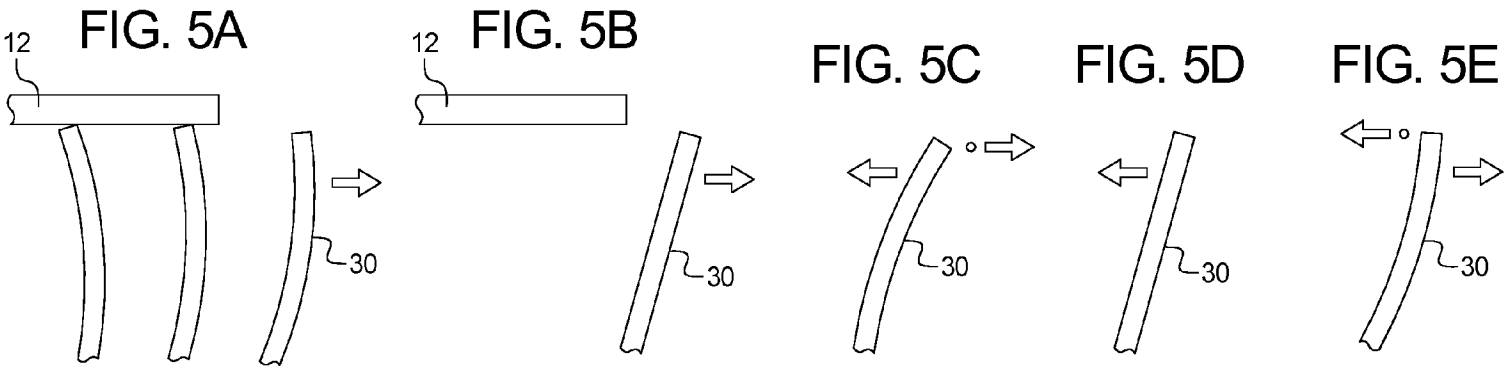
FIG. 5A
FIG. 5B
FIG. 5C
FIG. 5D
FIG. 5E
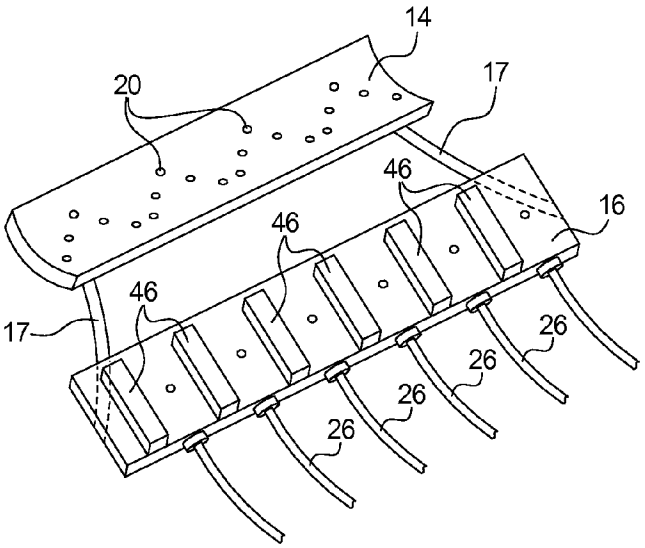
FIG. 6

MISTING AND ATOMIZATION SYSTEMS AND METHODS

CROSS-REFERENCE TO RELATED APPLICATIONS

This application incorporates by reference and claims priority to U.S. Provisional Application 61/835,529 filed on Jun. 14, 2013.

BACKGROUND OF THE INVENTION

The present subject matter relates generally to misting and atomization systems and methods that may be used to spray liquids, such as water, paint, and others.

There are various misting or spraying methods for various liquids. Each has its own drawbacks and challenges. Many of the problems with currently available systems and methods are well illustrated with reference to conventional paint sprayers or mist cooling atomizers. Accordingly, much of the present disclosure references these applications. However, it is understood that the teachings provided herein with respect to paint and mist cooling are applicable across a great range of fluids.

A common method for applying paint to a surface involves the use of a cylindrically shaped paint roller or brush dipped into a supply of paint. Whereas these methods provide adequate penetration of the paint to a surface, these methods are both time consuming and messy.

In contrast, spray methods have been developed that allow for a faster painting process, but these methods have their own disadvantages. Various spray painting systems have been proposed where the paint is delivered under power to a paint applicator. Unfortunately, in these systems the paint applicator has a tendency to become clogged, thereby rendering the system useless and requiring the user to buy a replacement device.

In addition, the current spray paint devices do not provide paint to a substrate in a controlled manner such that the paint is delivered at the proper rate. In order to achieve optimal atomization extremely high pressures must be used, forcing the equipment to spray over five gallons an hour in common working conditions. Only a very small percentage of highly trained technicians are capable of applying so great a torrent of paint accurately. Further, paint is often distributed with an improper uniformity or irregularity to a paint surface. Moreover, minor variations in paint viscosity by dilution produces unpredictable spray quality with the present devices. As a result, fine-tuning the spray by measuring viscosity is difficult with the present devices.

Further, instead of providing an even distribution of spray over a wide spray pattern, current spray devices may force spray through a tiny hole to provide a spray pattern that is uneven. More paint is delivered in the center of the spray than at the edges. In factory settings where a wide swath of paint is desired, complex set-ups of numerous nozzles must be designed and fine-tuned in their proximity one to another in order to approximate even distribution. And of course, if one of the nozzles clogs, the entire paint session is compromised. Additionally, the high pressures used in such systems rapidly wear out the nozzle, ruining the spray quality, and requiring frequent monitoring and replacement.

Another serious drawback to almost all conventional paint sprayers is overspray. For example, a fog of paint particles is produced by the atomization process that fills up whole rooms with tiny droplets that stick on any surface. Overspray is also dangerous: most spray paint must be applied while wearing a mask to prevent inhalation of the paint droplets, which can be life-threatening. In a factory setting, spray paint is usually applied in sealed boxes or small rooms with special blowers for ventilation. Spray paint applied in private homes demands protecting every surface where paint is not wanted by covering it with airtight layers of plastic sheeting. Even adjoining rooms must be protected this way. Overspray constitutes wasted paint that can often reach over 30% of all paint sprayed, a considerable loss, especially considering the considerable cost of the paint and cleaning up.

A further drawback of conventional spray paint methods is bounceback. Specifically, the atomization process frequently creates a high-speed blast of air moving around the paint droplets. The air blast air flow reflects off the application target and pushes other droplets on their way to the target away from the target completely. As a side effect of bounceback, many current paint sprayers are incapable of filling small cracks under 2 mm or so width with any paint to any depth. A further drawback to the high air flow causing the bounceback is that it blows on the droplets at great speed and can dry them out before they hit the target.

Moreover, many of the powered painting systems are complicated with numerous parts and, therefore, difficult to clean and repair. Cleanup of a sprayer, even the most expensive ones, can take hours and even require soaking overnight.

Changing paint colors in the middle of an application project is not an option for conventional equipment. Moreover, typical conventional systems are only suited for one type of liquid, namely, paint. Therefore, a user would need to purchase an entirely different device to supply other liquids, such as insecticides or air fresheners.

Further, the current powered painting systems require a substantial amount of energy, high pressure, electrical cords, battery packs, or pumps in order to supply the paint to a surface.

Cooling by water evaporation is another common application of atomization devices that presents its own range of challenges. Inexpensive cooling mists fail to atomize well, and produce sprays that are both uncomfortable and inefficient. For example, the large droplets produced by these low-cost atomization devices are so uncomfortable that it is virtually impossible to sit directly in the atomization path and air flow path. Second, the conventional atomization devices produce particles of a size so large that many of them never evaporate at all, thus failing to produce a cooling effect.

More expensive mist cooling systems do produce quality atomization. However, the high pressures required to produce the atomization have an undesired effect of raising the humidity in the environment of the device. For example, the water flow from a minimum four nozzle installation is rarely less than 0.116 gallons per minute and usually more than that—an amount of water so great that in one minute the device will increase the humidity of almost 2,000 cubic feet of air from 50% to 70% or more humidity. At such levels the evaporative cooling system becomes remarkably less efficient. In addition, this added humidity is uncomfortable to the users of the system, which typically use the system in order to cool themselves. In other words, the conventional systems deny the users the direct benefit of the cooling and greatly increase the overall humidity.

Further disadvantages of typical cooling systems include the high cost of the device relative to the minimal cooling they produce. In addition, the cooling devices typically produce uncomfortably large amounts of noise up to more than 60 decibels from the operation of the compressor, from the operation of fans large enough to handle the high levels of mist, and from the quite loud hissing of the nozzles. Further, the current cooling devices typically only produce mist from one spray nozzle at a time, necessitating multiple nozzles for increased cooling. Finally, because the atomization concentrates all the droplets into a very small area around the one tiny point from which they are all sprayed, the best atomizers have an additional drawback of creating a heavy fog which is distracting, uncomfortable, and easily re-condenses on smooth surfaces.

Accordingly, there is a need for a device to supply atomization in a consistent manner, quietly, with a relatively simple structure and assembly, such that the system leads to easy maintenance and cleaning, as well as adaptability during use.

BRIEF SUMMARY OF THE INVENTION

The present disclosure provides devices and methods for implementing an atomization device. Various examples of the device and method are provided herein.

The disclosed device provides a fine mist with critically smaller particles than those devices within the prior art. The fine mist is at least in part a result of the design of the device, which relies on the combination of two processes: first, a limited adhesion of liquid onto filaments, and second, a controlled oscillation of the filaments as they release one droplet at each oscillation. The liquid is released from the filaments in a stream after the filament is snapped and subsequently undergoes an oscillation process, wherein the filament bends forward and back through a neutral position of the filament.

Specifically, the disclosed device includes a brush and a contact plate, wherein the contact plate includes a plurality of capillary openings. Liquid is supplied to a cavity or space beneath the capillary openings for the capillaries to absorb into the capillary openings without additional force. In the operation of the device the capillary tubes can be 'starved' of liquid—never provided with enough liquid to fill them to the limit that capillary action would allow. Instead, the meniscus at the top of the tubes can become bent in an exaggerated hyperbola to present only a small edge of liquid to contact from above. As the brush contacts the contact plate, it's filaments are dragged one by one over the capillary openings, where small amounts of liquid (in the range of 0.00001 cubic centimeter) inside the capillary openings adhere to the individual filaments of the brush. As the brush rotation continues, the filaments maintain contact with the plate, carrying with them this liquid. The liquid is then broken up into even smaller parts and released from the filaments when the filaments break contact with the contact plate and oscillate, releasing one drop at a time with each direction change. In the case of a brush spinning axially, the liquid is released approximately 180 degrees from the contact plate. The contact plate may include a compressed radius, wherein the filaments undergo a continuous bending and release operation deforming the filaments from their rest state, building up and releasing their elastic potential energy without creating any impact that would cause the filaments to shed any liquid before the point of release. The compressed radius prevents an excess of liquid buildup from collecting at the release point.

When used with liquids of the viscosity of water, the depth of the enclosed cavity beneath the contact plate is fixed at approximately 1 to 2 millimeters, providing a vital, very simple and low-cost method of continually supplying liquid to the capillary openings without flooding them. By means of capillary and other forces acting on the liquid in the narrow space it defines, the space forces the liquid to disperse itself evenly throughout the area beneath the capillary tubes, without allowing the formation of full-sized droplets which, if adhered to the filaments, would destroy quality atomization. This is accomplished with a simple mechanical structure without moving parts. Furthermore, relying on the various properties of water-like liquids that function in this small a space, the cavity now allows the device to be used in any orientation, preventing gravity from collecting the liquid too much in any one place and flooding the filaments. If the device is used to atomize a liquid of the viscosity of water, the space may be 1 to 2 mm in depth, at which distance the water will be dispersed and fill up the space according the natural viscosity, capillary action and adhesive powers of the liquid. If a surfeit of liquid is prevented from entering the space, these natural forces will keep the liquid firmly inside the space, preventing it from leaving the top of the capillary tubes unless the filaments drag small amounts out by adhesion, and allowing the device to be utilized in any orientation, even upside down, without any liquid leaving the space by forces other than the adhesion of the filaments.

The specific design of the present device releases liquid absorbed onto filaments or bristles approximately 180 degrees from a contact plate, wherein the contact plate provides the liquid to the filaments. In contrast, most conventional misting devices that rely on flicking to produce atomization spray approximately 90 degrees from a snap bar.

The liquid released in the stream begins approximately three hundredths of a second after the filament is snapped from a contact plate, which is also the time it takes for the first oscillation. The stream continues for up to two tenths of a second afterwards. In contrast, conventional misting devices flick larger sized droplets of liquid directly off a bar at the moment the filament is released. In other words, the present system includes an oscillation function that produces much smaller droplets than conventional low rpm devices that do not include an oscillation function.

As the brush contacts the contact plate, a very small amount of liquid inside the capillary openings adheres to the tips of the filaments of the brush. The limited adhesion property of the device is such that the amount of liquid available to each filament as it is dragged over the capillary openings is about 0.00001 cubic centimeter. In contrast, conventional devices grant filaments access to much larger amounts of liquid at this stage, where natural forces make them absorb many times more liquid than the present device, drastically increasing the size of the particles that are subsequently released and lowering the quality of atomization. Only very high rpm's can atomize these amounts of liquid effectively, and then only at a high cost in energy and noise. As a result of the limited adhesion process, the present devices produces a fine mist at rpm's of 800 or even 400, a fraction of the thousands of rpm's required by other devices to achieve good atomization.

The atomization of the liquid from the device is a result of releasing the flexed filaments from contact plate, wherein the filament returns to its resting or normal linear position. Specifically, after release, the filament moves through its normal linear position into a forward flexed position before returning back to its normal linear position. The oscillation produces atomization because the acceleration produced from the oscillation is comparable to that of a spinning disc atomization system rotating at 3,500 rpm. Because the oscillations continue after the filament is released, and because the filament is in an axial spin conformation, the liquid is released 180 degrees from the contact plate. Further, this oscillation process greatly enhances the atomization by breaking up the tiny amount of liquid on the filament head into even smaller amounts: only one droplet is released with each oscillation of a filament. Determination of the number of oscillations and the strength providing the oscillation is enough force to atomize the liquid is dependent on understanding numerous properties of the filament material, thickness, length, and the amount by which the filament is bent before release. Atomization by oscillation prevents overspray: the particles are all ejected with parallel forward momentum and identical forward speed at the extreme end of the oscillation cycle. So they never hover and wander away from the stream like the product of traditional pressure sprayers. Further, the oscillation provides the benefit of a highly diffused swath of atomized particles, separated from each other automatically by the one-at-a-time release of particles.

The length of the filaments may be any suitable length. For example, shorter filament lengths produce a faster snap to release the liquid from the filament. Shorter filaments are particularly suitable for releasing higher viscosity liquids, such as paint. A greater rotation speed also increases the snap force. The filaments may be made of any material that has elastic potential energy on deformation, including stainless steel, spring steel, and other materials.

No bounce-back: the device produces next to no air flow accompanying the droplets, since the air flow produced by spinning the filaments is nearly negligible. At the same time, the device may produce liquid particles or droplets that are projected at a rate that is faster than the forward momentum created by the rotation of the filaments, because the speed of the snap is additional to the speed of the rotation of the brush. For example, when the brush is rotated at approximately 900 rpm, a forward speed of 2 m/s is produced, and the snap of the filaments off the contact plate adds an additional 2 m/s to the speed of the projected droplets. This combination of the droplets having high air speed, and the air surrounding them having very low speed, means that instead of 'bounce back', the droplets actually race ahead of the air flow unencumbered. As a result, the device is suitable for dispensing a mist of paint to cover inside cracks on a substrate as thin as 1 mm wide and over 10 mm deep.

The present disclosure provides an atomization device including a contact plate including a top plate and a bottom plate, wherein the top plate and bottom plate are separated a distance to define a space between them. The top plate includes a plurality of capillary openings that extend through the top plate from a top surface to a bottom surface. The device further includes a liquid source in fluid communication with the space, wherein the liquid source supplies a limited amount of liquid to the space and the plurality of capillary openings, and a brush including a plurality of a filaments radiating from a central axis of the rotating brush.

As the brush rotates a first radial direction, the filaments flex when in contact with the contact plate and release when contact is broken with the contact plate to project liquid from the filaments, wherein the portion of the contact plate with which the filaments contact includes a spirally curved surface, wherein the radius decreases along a path following the first radial direction.

In an example, the device includes a cylindrical housing, wherein the housing includes the contact plate and the rotating brush, wherein the housing includes an opening, wherein, as the brush rotates, liquid from the filaments projects through the opening. The housing may include a top portion and a bottom portion, wherein the contact plate is positioned within the bottom portion, wherein the opening is positioned within the top portion.

In another example, the device includes an arcuate barrier extending from below the contact plate around a portion of the brush, wherein the arcuate barrier collects a portion of a liquid released from the filaments, wherein the barrier is in fluid communication with the liquid source. The barrier may collect non-atomized, larger droplets that are immediately released from the contact plate by the filaments. The large droplets are the sole product of many conventional atomization devices. In contrast, the present device removes the large droplets from the stream to maintain a desired smaller droplet size in the form of mist. In addition, the barrier may catch droplets that have been hurled backwards by the oscillation of the filaments. In other words, only liquid projecting from filaments in a forward direction from the oscillation produce the resulting mist. The liquid projected from backward oscillation movement may be collected by the barrier.

The rotation of the brush may be driven by a motor or manually. In an example, the device is configured to convert 600 mL of liquid into a mist per hour.

In an example, the device is enabled to dispense liquid from the filaments, wherein the liquid may be projected in the form of liquid particles, wherein at least 50% of the liquid particles have a diameter size of 100 microns or less. The device may be adapted to produce liquid particles having a size between, and including, 20 μm to 350 μm. The device may be adapted to produce liquid particles having a size between, and including, 20 μm to 100 μm.

The diameter of the capillary openings may be between, and including, 0.5 mm to 2.0 mm. In an example, the diameter of the capillary openings is 1 mm, 1.5 mm, 2 mm, or 2.5 mm.

The capillary openings may include liquid, wherein a portion of the liquid carried by the filaments is released from the filaments approximately 180 degrees from the contact plate, wherein the approximately 180 degrees is measured along the radial path of the rotating brush.

The liquid source may control the release of liquid to maintain an amount of liquid in the capillary openings such that the liquid does not overflow onto the top surface of the top plate. In an example, the liquid source includes a positive pressure source, wherein the positive pressure maintains an amount of liquid between the top plate and bottom plate.

The present disclosure also provides an atomization method including providing a atomization device, as disclosed above. The method further includes rotating the brush such that the filaments contact the contact plate, wherein the filaments absorb a portion of the liquid feeding to the filaments from within the capillary openings. As the brush rotates a first radial direction, the filaments flex when in contact with the contact plate and release when contact is broken with the contact plate to project liquid from the filaments, wherein the portion of the contact plate with which the filaments contact includes a spirally curved surface, wherein the radius decreases along a path following the first radial direction.

The method may include, when contact is broken with the contact plate, the filament oscillates between a forward bend position and a backwards bend position through a linear position, wherein the filament projects liquid each time the filament changes direction, at the forward bend position and at the backward bend position.

An advantage of the device provided herein includes providing a more cost effective, energy efficient misting device than those devices that use high rpm's of discs or brushes, or high pressure to dispense the liquid. In the present device, energy is only expended when atomization takes place. In contrast, in conventional devices, a majority of the energy required by the device is wasted maintaining a constant supply of power for the device, even through a great majority of the power is not used for the actual atomization.

Another advantage of the device is that it is quiet: atomization by oscillating filaments produces so very little noise that it can comfortably be utilized in residential surroundings. The device can operate within the recommended sound pressure for interior living areas, under 50 decibels at a distance of 6 feet from the unit. For example, many current mist cooling systems are over ten times louder than this, 60 decibels and more.

Another advantage of the device provided herein is that the device may be used to dispense paint, insecticide, air freshener, among other things, in contrast to current misting or spraying devices which are only designed to spray one type of material. The present device may include interchangeable rotating brushes and barriers which may be selected depending on the type of material or liquid used. For example, a user may find it advantageous to use a different rotating brush for use with a latex based paint than when used with water. For example, stiffer bristles may be helpful when the device is used with paint.

Yet another advantage of the device is that it produces a more moderate rate of spray than other conventional devices. As a result, users of the device may apply a spray at a more manageable rate of one inch per second for painting a trim line accurate to 1/16th of an inch. Therefore, the present device may be easily operated by any person, not just professionals.

Another advantage of the device when used for mist cooling is that the device produces a comfortably fine and highly diffused cooling mist for users, wherein the stream may be pointed directly on the user. Further, such a direct stream can provide ample cooling with much more efficient water use than other systems that because of the discomfort of their direct stream must rely on cooling the entire atmosphere around the subject. Using much less water for evaporation, the present device does not increase the humidity of the environment as much as those systems.

Yet another advantage of the device is that the spray originates over the entire length of the brush, not just in one point. The spread of liquid produces a more even coverage of paint.

Another advantage of the device provided herein is that the device does not clog, in contrast to most commercial misting devices. With no passage smaller than about 1 millimeter in the case of water misting, and about 2 millimeter in the case of paint spraying, ample room is provided for all common foreign matter in an ordinary liquid to pass without clogging. Further, in the example of dispensing latex paint, the device does not require dilution of the paint before dispensing.

A further advantage of the device provided herein is that the device is convenient and easy to take apart and clean.

Yet another advantage of the device disclosed herein is that the device is designed to easily modify the size of the swath of mist extruded from the device, even during use. For example, swaths of spray greater than 20 feet long may be produced, which is typically not achievable by other conventional systems without using multiple nozzles. Further, the swath size produced by the present device may be modified during use of the device.

Another advantage of the present invention is a substantial reduction in overspray. In other words, the present device prevents the loss of excess spray that is sacrificed as waste. Due to the lack of overspray, the present device is safer for users to use. The device does not produce overspray because the device does not project the droplets in all directions like conventional spraying devices, which produce a cloud of mist that the user has to avoid inhaling. Instead, the present device produces a spray in a direct line of paint droplets.

A further advantage of the present device is that it in some conformations it may be used in any orientation. In contrast, conventional sprayers may only be used in one orientation. The present device may be tilted and even turned upside down during use.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

FIGS. 5A-5E is a side view of an embodiment of a filament before and after breaking contact with the contact plate.

FIG. 6 is an exploded view of an embodiment of a contact plate.

DETAILED DESCRIPTION OF THE INVENTION

Figure 1:
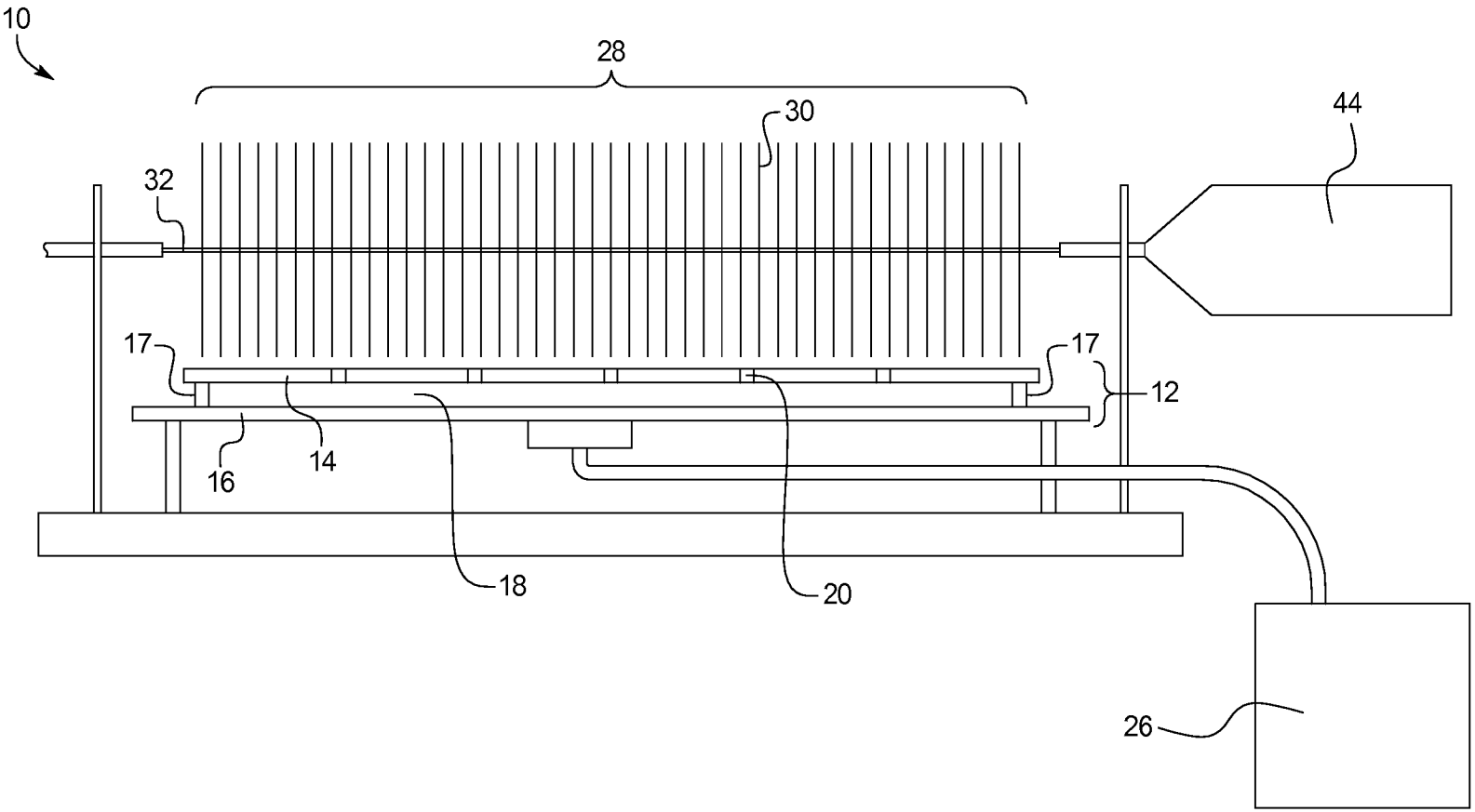
FIG. 1 is a side view of an embodiment of an atomization device.
Figure 2:
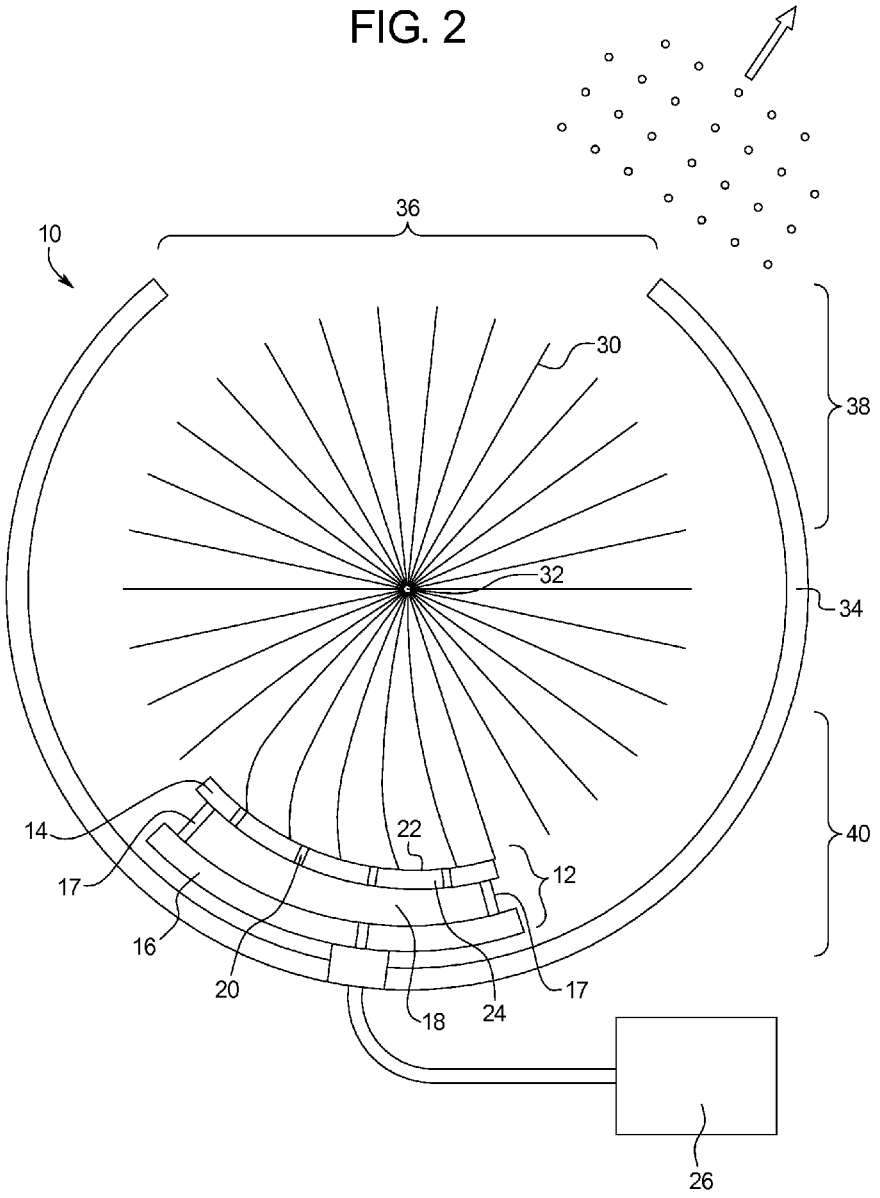
FIG. 2 is a cross-sectional view of an embodiment of an atomization device including a housing.
Figure 3:
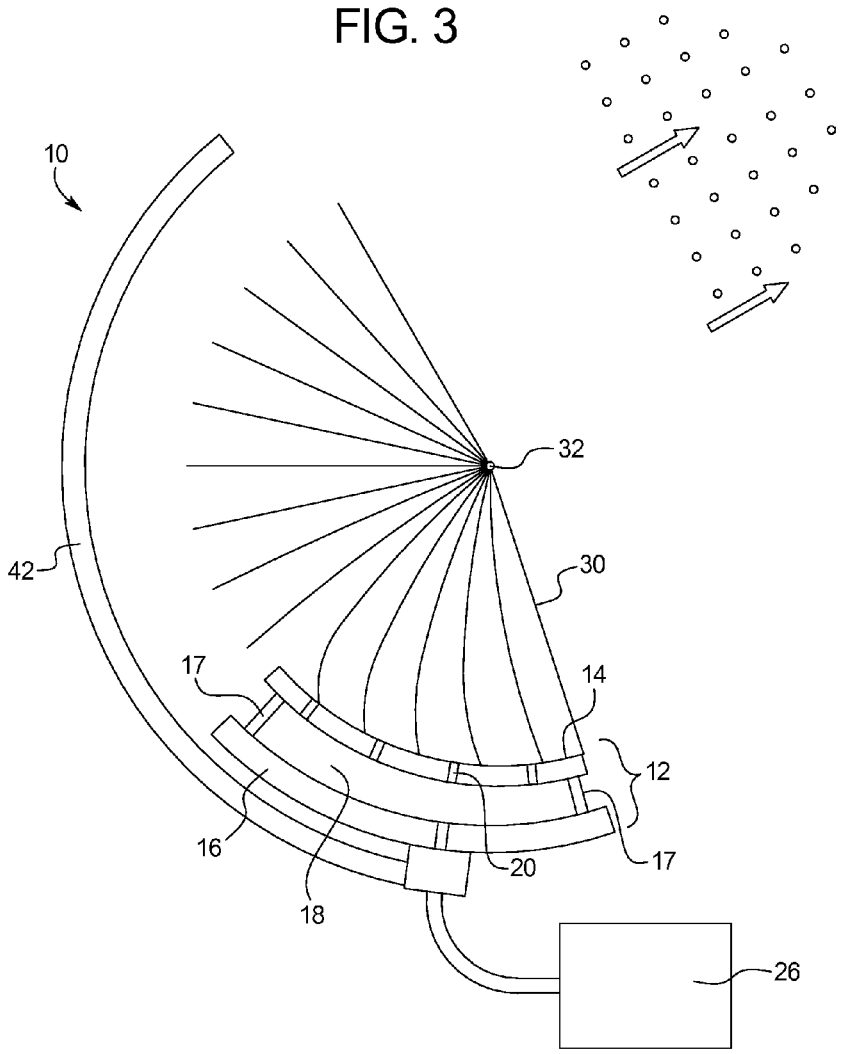
FIG. 3 is a cross-sectional view of an embodiment of an atomization device including a barrier.

FIG. 1 depicts an embodiment of an atomization device 10 as provided by the present disclosure, wherein the device 10 includes a contact plate 12, a liquid source 26, and a brush 28. The contact plate 12 includes a top plate 14 and a bottom plate 16. The top plate 14 and bottom plate 16 are connected such that a connector 17 encloses a space 18 between the top plate 14 and bottom plate 16. The top plate 14 may be connected to the bottom plate 16 by any suitable connector 17, as shown in FIGS. 1-3. The connector 17 may include, but not limited to, a wall, screw, nail, bolt, latch, among others. Further, the connector 17 may be any suitable material, such as plastic. Alternatively, the top plate 14 and bottom plate 14 may be directly connected to each other, for example, by welding, glue, or any suitable adhesive.

The top plate 14 includes a plurality of capillary openings 20 that extend through the top plate 14 from a top surface 22 to a bottom surface 24. The capillary openings 20 are adapted to absorb liquid from the space 18 below the top plate 14 based on capillary action, and to present extremely small amounts of the liquid to adhere to the heads of the filaments 30 when they contact the tops of the openings. The diameter of the capillary openings 20 may be increased or decreased to suit liquids of different viscosity, or to modify a projected droplet size. The capillary openings 20 may be arranged in any suitable manner that ensures the filaments 30 which are to atomize in the desired process have access to the liquid within the capillary openings 20. For example, the capillary openings 20 may be arranged in a staggered grid pattern.

The diameter of the capillary openings 20 may be any suitable diameter to produce atomization of the liquid. The diameter of the capillary openings 20 may be at least 0.1 mm, at least 0.3 mm, at least 0.5 mm, at least 0.7 mm, at least 0.9 mm, or at least 1.1 mm. Alternatively, or in addition to, the diameter of the capillary openings 20 may be less than 3 mm, less than 2 mm, less than 1.5 mm, less than 1.3 mm, less than 1.1 mm, less than 0.9 mm, less than 0.7 mm, or less than 0.5 mm. The diameter of the capillary openings 20 may be defined by any two of the above endpoints. For example, the diameter of the capillary openings 20 may be between, and including, 0.5 mm to 1.5 mm, 0.9 mm to 1.1 mm, 0.7 mm to 1.3 mm, or 0.9 mm to 1.3 mm. In an example, the diameter of the capillary openings 20 is 1 mm.

The space between the top plate 14 and the bottom plate 16 may be approximately from 0.5 mm to 2 mm, for example 1 mm. Due to the close proximity of the top plate 14 and bottom plate 16 in addition to the interplay of capillary action in the case of a liquid with the viscosity of water, the device 10 may be used in any orientation. In other words, the contact plate 12 adequately supplies liquid through the capillary openings 20 to the filaments 30 in any orientation of the device, including upright or upside down.

In addition, a portion of the contact plate 12 includes a spirally curved surface with which the filaments 30 contact. As the brush 28 rotates in a first radial direction, the radius of the spirally curved surface decreases along a path following the first radial direction. As a result, a filament 30 of the brush is progressively more intensely flexed as the filament 30 approaches the end of the spirally curved surface.

An advantage of the top plate 14 including a spiral curved surface includes preventing the accumulation of liquid behind a strike plate, an element common in conventional sprayers that is used to snap bristles to release their droplets. Any liquid that accumulates behind a strike plate is typically attached to subsequent approaching bristles, and will drastically increase the projected drop size and negatively impair atomization. The spiral curved surface of the top plate 14 maintains an optimal amount of liquid on the filaments 30 and prevents liquid from accumulating on the top surface 22 of the top plate 14 and subsequently absorbed by filaments 30, which negatively impairs atomization.

As mentioned above, the device 10 further includes a liquid source 26 in fluid communication with the space 18, wherein the liquid source 26 supplies a liquid to the space 18, wherein the plurality of capillary openings 20 access the liquid from the space 18. As shown in FIGS. 1-3, the liquid source may attach to the bottom plate 16, for example through an opening within the bottom plate 16, wherein the liquid may flow from the liquid source 26 into the space 18. The liquid source 26 may supply any suitable liquid to the space 18.

The liquid source 26 may control the release of liquid to maintain an amount of liquid in the space 18 such that the liquid does not overflow the capillary openings 20 and onto the top surface 22 of the top plate 14. In an example, the liquid source 26 includes a positive pressure source, wherein the positive pressure maintains an amount of liquid between the top plate 14 and bottom plate 16.

The liquid source 26 may be externally located from the contact plate 12. Alternatively, or in addition to, the liquid source 26 may be internally located within a housing 34, discussed more below. Further, the liquid source 20 may be in fluid communication with a liquid reservoir that supplies the liquid source 20 with liquid.

In one example, if the amount of liquid supplied from the liquid source 26 is too great, the device 10 will not produce a consistent mist of liquid, but rather dispense inconsistent droplets of too large a size. Alternatively, if the amount of liquid supplied from the liquid source 26 is too little, the device 10 may not produce a consistent mist of liquid, but instead have gaps in its spray. Preferably, the liquid source controls the release of liquid to maintain an amount of liquid in the capillary openings less than a full capacity of the capillary openings.

The liquid supplied by the liquid source 20 may be any suitable type of liquid including, but not limited to, water, paint, insecticide, air freshener, fuel, pharmaceutical coatings, industrial coatings, industrial oil, cooking oil, body creams, combustible liquid or petroleum derivatives, or a combination thereof. In the main embodiments described herein, the misting device 10 is generally configured to perform with paint, which is a fluid that has shear thinning properties (i.e., the fluid's resistance to flow decreases with an increasing rate of shear stress). However, one skilled in the art would understand to slightly modify the elements of the systems disclosed herein for liquids that are not shear thinning materials based on the solutions and description provided herein.

The device 10 also includes a brush 28 including a plurality of a filaments 30 radiating from a central axis 32 of the rotating brush 28. As the brush 28 rotates a first radial direction with the filament heads in contact with the plate, liquid adheres to the filament heads from within the capillary openings, the filaments 30 flex when in contact with the contact plate 12 and release when contact is broken with the contact plate 12 to project liquid from the filaments 30. Once contact is broken between the filaments 30 and the contact plate 12, the oscillation process begins, which will atomize the liquid on the filaments, one drop with each oscillation. Alternatively, the brush 28 may be linear, wherein the filaments 30 extend from one side of the brush 28. In such example, instead of rotating the brush, a horizontal brush 28 may slide or vibrate over the contact plate 12.

The filaments 30 may be comprised of various materials with a range of flexibilities. In one example, the filaments 30 may comprise flexible material. The level of flexibility of the filaments 30 must be such that, upon contact with the contact plate 12, the filaments 30 bend or flex from their original orientation. Upon release from the contact barrier 12, the filaments 30 oscillate rapidly until the filaments 30 return back to their original, linear orientation, thereby releasing liquid from the filaments 30 in each oscillation.

As explained more below, upon release, the filaments 30 typically not only spring back into their original orientation, but continue to bend past their original orientation into a forward bend position and then back to their linear position. The filaments 30 may then bend back to a backwards bend position, after which the filament 30 returns back to the linear position. This oscillation from the forward bend position to the backwards bend position creates the mist or atomization as the liquid leaves the filaments 30 each time the filament 30 oscillates away from the forward or the backward bend position. The filaments 30 are flexible enough to bend and spring back to their original orientation to allow the liquid on the filaments 30 to be projected in the form of a mist. In an example with a filament 30 having a length of one inch, the filament 30 may oscillate approximately 20 times before returning to its neutral, linear position.

The filaments 30 may be equally dispersed on the rotating brush 24. Alternatively, the filaments 30 may be arranged in any number of patterns, such as rows, along the rotating brush. The projected droplet size can also be moderated by changing the distribution of filaments 30 across the face or the surface of the central axis 32 of the brush 28. The more spread out the filaments 30 are on a surface of the central axis 32, the more discreet individual droplets are projected. Further, the filaments 30 may extend perpendicular from a surface of the brush 24. Alternatively, the filaments 30 may extend at an angle other than perpendicular, such as sloping backwards from the direction of rotation so as to project droplets in a direction closer to a line pointing outwards from the center of the brush (in contrast to a tangential line of droplets projected by filaments 30 extending perpendicular from the brush 24).

The length of the filaments 30 may be any suitable length to produce atomization of the liquid. The length of the filament 30 may be at least 10 mm, at least 15 mm, at least 20 mm, at least 25 mm, at least 30 mm, at least 35 mm, or at least 40 mm. Alternatively, or in addition to, the length of the filaments 30 may be less than 50 mm, less than 45 mm, less than 40 mm, less than 35 mm, less than 30 mm, less than 25 mm, or less than 20 mm. The filaments have a length defined by any two of the above endpoints. For example, the length of the filaments 30 may be between, and including, 15 mm to 50 mm, 25 mm to 30 mm, 20 mm to 40 mm, or 25 mm to 35 mm.

In one example, the rotating brush 28 is replaceable. For example, the user may replace the rotating brush 28 with a different rotating brush 28 that has, for example, a different density of filaments 30 or a brush that has a different pattern of filaments 30, thereby allowing the user to create various misting conditions and patterns.

The rotating brush 28 may be driven by an electrical motor 44. Alternatively, the rotating brush 28 may be driven by a manual crank, such as a thumb roller. In either case, a user may be able to designate or otherwise control the speed of rotation of the brush 28. In an example, the device 10 is configured to convert 500 mL to 800 mL of liquid into a mist per hour. For example, the device may be configured to convert 600 mL of liquid into mist per hour.

In an example, as shown in FIG. 2, the device 10 includes a housing 34. In one example, the housing 34 is generally cylindrical. However, the size and shape of the housing 34 is not limiting. While FIG. 2 shows a generally cylindrical housing 34, it is understood that the housing may be any number of shapes adapted to support the misting device 10. The housing 34 may include the contact plate 12 and the rotating brush 28. The housing 34 may include an opening 36, wherein, as the brush 28 rotates, liquid from the filaments 30 project through the opening 36. For example, the housing 34 may include a top portion 38 and a bottom portion 40, wherein the contact plate 12 is positioned within the bottom portion 40, wherein the opening 36 is positioned within the top portion 38.

The shape of the opening 36 may be any suitable shape. For example, the shape of the opening 36 may be generally rectangular, square, circular, or oblong. The opening 36 may be a narrow slit, a small circular opening, or a larger rectangular opening. Further, the housing 34 may include more than one opening 36, thus, allowing the device 10 to provide various patterns of misting. For example, the top portion 38 of the housing 34 may include a row or series of small openings 36.

In an example, the size of the opening 36 in the top portion 38 of the housing 34 may be adjustable. For example, the opening 36 can be enlarged or diminished manually or electronically. In the case of manual adjustment, the opening 36 may have adjustable components that allow a user to change the shape of the opening, even during use. In addition, the capillary openings 20 may be capable of being opened and closed in certain groups, allowing for a customized liquid spray swath.

In another example, as shown in FIG. 3, the device 10 includes an arcuate barrier 42 extending from below the contact plate 12 around a portion of the brush 28, wherein the arcuate barrier 42 may collect a portion of a liquid released from the filaments 30. The barrier may be a portion of the housing 34. Alternatively, the barrier 42 may be in addition to the housing 34.

As shown in FIG. 3, the barrier 42 extends from below the contact plate 12 to approximately 90 degrees from the contact plate 12, wherein the approximate 90 degrees is measured along the radial path of the filaments 30. In such example, the barrier 42 may collect any liquid prematurely released at or less than 90 degrees. The barrier 42 may in fluid communication with the liquid source 26, such that the collected liquid may be fed back into the liquid source 26.

In the case of a radial rotation of the brush holding the filaments, a portion of the liquid carried by the filaments 30 is released from the filaments approximately 180 degrees from the contact plate 12 in the form of a mist, wherein the approximately 180 degrees is measured along the radial path of the rotating brush 28. Because atomization does not take place until the filaments 30 oscillate, and the oscillation only starts after the filaments 30 have rotated approximately 90 degrees, the direction of the sprayed droplets is 180 degrees from the contact plate 12. In contrast to conventional sprayers that sling liquid approximately 90 degrees from a snap plate without any oscillation process, the present device projects mist at approximately 180 degrees from the contact plate 12.

The device 10 may be configured to produce atomized particles of any suitable size or shape. For example, to produce larger particles, the rotation rate of the rotating brush 28 may be slowed down, the amount of liquid supplied to the filaments 30 may be increased, the diameter of the capillary holes may be increased, the thickness of the filaments 30 may be increased, the stiffness of the filaments 30 may be decreased, or combination thereof. Alternatively, to decrease the size of the liquid particles extruded from the device 10, the rotation rate of the rotating brush 28 may be increased, the amount of liquid supplied to the filaments 30 may be decreased, the diameter of the capillary holes may be decreased, the thickness of the filaments 30 may be decreased, the stiffness of the filaments 30 may be increased, or a combination thereof. The shape of the particles may be spherical, ovular, torpedo-shaped, cylindrical and bullet-shaped. Further, the device 10 may be configured to spray the liquid particles varying distances, for example, the stiffness of the filaments 30 may be increased to spray the particles longer distances compared to filaments 30 with decreased stiffness. Finally, the device may atomize liquid so rapidly that it produces immediate evaporation of liquid into gas, skipping entirely the intermediary step of creation of small particles.

The liquid particles may have an average size (i.e., average particle diameter) of at least 10 μm, at least 20 μm, at least 30 μm, at least 40 μm, or at least 60 μm. Alternatively, or in addition to, the liquid particles may have a diameter size of 350 μm or less, 300 μm or less, 200 μm or less, 180 μm or less, 160 μm or less, 150 μm or less, 120 μm, 100 μm or less, 50 μm or less, or 20 μm or less. The liquid particles can have an average particle size bounded by any two of the above endpoints. For example, the liquid particles may have an average particle size of 10 μm to 20 μm, 10 μm to 50 μm, 10 μm to 200 μm, 20 μm to 100 μm, 20 μm to 3500 μm 50 μm to 120 μm, 20 μm to 150 μm, or 60 μm to 100 μm. In an example, the device 10 is enabled to dispense liquid from the filaments 30, wherein the liquid may be projected in the form of droplets, wherein at least 50% of the droplets have a diameter size of 100 microns or less.

In an example, the device 10 is configured to produce approximately 7 droplets of average diameter size of 115 microns per complete oscillation cycle of each filament, converting approximately 0.25 mL of liquid into mist per hour per filament 30, when the filament 30 passes through approximately 800 cycles of liquid adhesion and oscillation of mist per minute.

Figure 4A:
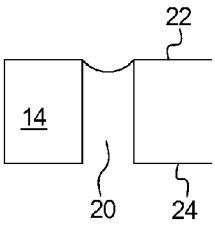
FIGS. 4A-4C is a side view of an embodiment of a filament in contact with a capillary opening.
Figure 4B:
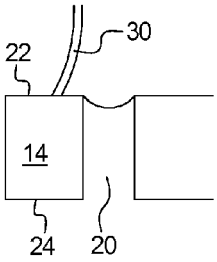
Figure 4C:
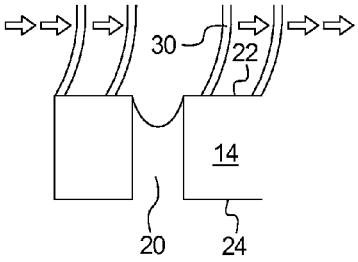

The present disclosure also provides an atomization method including providing any of the embodiments of the atomization device 10 disclosed above. The method further includes rotating the brush 28 such that the filaments 30 contact the contact plate 12, wherein the filaments 30 absorb a portion of the liquid available to the filaments 30 from within the capillary openings 20. As shown in FIGS. 4A-4C, a filament 30 brushes over the top plate 14 of the contact plate 14 and absorbs liquid from the capillary opening 20 even though no external source is forcing any additional liquid through the capillary opening 20. As shown in the progression between FIG. 4B to FIG. 4C, once approximately one hundred filaments 30 pass over the capillary opening 20, the height of the meniscus of the liquid inside the capillary opening 20 decreases by approximately 1 mm, wherein the capillary opening has a diameter of 1.1 mm. This conforms to the rough estimate in item 0019 of each filament absorbing approximately 0.00001 of a cubic centimeter of liquid with each pass over a capillary tube: 100 times 0.00001 cubic cc=0.001 cubic cc, or about 1 cubic millimeter, the volume of liquid lost to the capillary opening.

As the brush 28 rotates a first radial direction, the filaments 30 flex when in contact with the contact plate 12 and release when contact is broken with the contact plate 12 to project liquid from the filaments 30. As shown in FIGS. 5A-5E, after the filaments 30 are released from the contact plate 12, the filaments 30 return to a neutral (linear) position, then continue to bend in the opposite direction of the flexing from the contact plate 12. Then the filaments 30 return back to the neutral position again, and then bend backwards past neutral, releasing one drop with each change in direction. The particular oscillation cycle of the filaments 30 to bend beyond the neutral or linear position of the filament 30, creates the claimed atomization. In other words, bristles of conventional sprayers may be merely bent back and then snapped forward to return to their linear position, applying a flicking motion instead of the oscillating motion utilized by the present device.

A 0.012 nylon filament 30 that is one inch long produces 22 cycles of oscillation, or about 44 recoils. In oscillation tests a filament 0.012" in diameter 1" long can cast a stream of individual droplets separated by identical intervals of time in the range of 22 droplets per ¼ second in one direction. The device 10 utilizes approximately the first 15% of the oscillations when operated at 600 rpm. With each oscillation, the filament projects one droplet of liquid adhering to the end of the filament 30 in the forward direction of rotation, and another in the backward direction. The acceleration at the point of reversal of direction is comparable to the power concentrated at the atomizing point of a spinning disc atomization system rotating at 3,500 rpm.

FIG. 6 depicts an embodiment of the contact plate 12, wherein the bottom plate 16 includes stays 46 that extend vertically from a top surface of the bottom plate 16 to the bottom surface 24 of the top plate 14. In addition, the bottom plate 16 may include multiple liquid sources 26, such that liquid is fed into the individual spaces 18 between the stays 46. As a result, a liquid source 26 is adapted to supply liquid to a portion of capillary stays between stays 46. Such example is particularly suitable for atomizing more viscous liquids such as paint that are not suitable to the capillary plate design used for water, which can already be used in any orientation.

The stays 46 allow the device to be used in various orientations. In other words, the device 10 may be tilted during use while still maintaining adequate misting ability. Without the incorporation of the stays 46, when the device is tilted, all of the liquid in the space 18 may accumulate in one end of the space 18. As a result, only the capillary openings 20 at the end where the liquid is accumulated will absorb the liquid, thereby altering the availability of the liquid to the filaments 30. In contrast, with the incorporation of the stays 46 between the top plate 14 and the bottom plate 16, the device 10 may be tilted without the liquid accumulating at one end of the space 18. Instead, the stays 46 ensure an adequate amount of liquid is accessible by all of the plurality of capillary openings 20 regardless of the orientation of the device 10.

The device 10 may further include an overflow mechanism configured to maintain an adequate amount of liquid in the liquid source 20 in order for the device 10 to produce a consistent mist of liquid. The overflow mechanism may be any mechanical or electrical device configured to maintain a specific amount of liquid in the liquid source 26. The overflow mechanism may be in communication with liquid source 26, such that upon feedback from the liquid source 26 that the amount of liquid exceeds the optimal amount for the device 10 to produce a continuous mist, the overflow mechanism stores or directs excess liquid to a liquid reservoir. The overflow mechanism may be in communication with the space 18, such that upon feedback from the space 18 that the amount of liquid exceeds the optimal amount for the device 10 to produce adequate atomization, the overflow mechanism stores or directs excess liquid to the liquid source 26. In another embodiment, the device 10 may include a float valve configured to maintain a certain amount of liquid in the space 18. Alternatively, the predetermined level or height of the liquid in the space 18 may be made adjustable using an adjustment knob.

The device 10 may further comprise an air force mechanism that provides air flow that further aids in mist production. The air force mechanism may be any mechanism that provides air flow, for example, although not limited to, a fan. For example, the air flow may flow along the length of the rotating brush 28. Alternatively, the air force mechanism may provide air flow that is tangential to the rotation of the rotating brush 28. For example, the air force mechanism may provide air in the direction of the opening 36 in the housing 34, thereby aiding the release of liquid from the filaments 30. The air force mechanism may also provide a cooling effect, for example, when the liquid is water.

It should be noted that various changes and modifications to the embodiments described herein will be apparent to those skilled in the art. Such changes and modifications may be made without departing from the spirit and scope of the present invention and without diminishing its attendant advantages. For example, various embodiments of device 10 may be provided based on various combinations of the features and functions from the subject matter provided herein.

I claim:

1. An atomization device comprising:

a contact plate including a top plate and a bottom plate, wherein the top plate and bottom plate are separated a distance to define a space between them, wherein the top plate includes a plurality of capillary openings that extend through the top plate from a top surface of the top plate to a bottom surface of the top plate;

a liquid source in fluid communication with the space, wherein the liquid source supplies a liquid to the space and the plurality of capillary openings; and a brush including a plurality of a filaments radiating from an central axis of the rotating brush, wherein, as the brush rotates a first radial direction, wherein the filaments flex when in contact with the contact plate and release when contact is broken with the contact plate to project liquid from the filaments, wherein the portion of the contact plate includes a spirally curved surface with which the filaments contact, wherein the radius decreases along a path following the first radial direction.

2. The atomization device of claim 1 further including a housing, wherein the housing includes the contact plate and the rotating brush, wherein the housing includes an opening, wherein, as the brush rotates, liquid from the filaments project through the opening.

3. The atomization device of claim 2 wherein the housing includes a top portion and a bottom portion, wherein the contact plate is positioned within the bottom portion, wherein the opening is positioned within the top portion.

4. The atomization device of claim 1 further comprising an arcuate barrier extending from below the contact plate around a portion of the brush along a path following the first radial direction, wherein the arcuate barrier collects a portion of a liquid released from the filaments, wherein the barrier is in fluid communication with the liquid source.

5. The atomization device of claim 1 wherein the brush is driven by a motor.

6. The atomization device of claim 1 wherein the diameter of the capillary openings is between, and including, 0.5 mm to 2.0 mm.

7. The atomization device of claim 1 wherein the filaments are 1 inch in length and wherein the filaments are nylon.

8. The atomization device of claim 1 wherein the device is configured to convert 0.25 mL of liquid into a mist per hour per filament.

9. The atomization device of claim 1 wherein the device is adapted to produce liquid particles, wherein at least 50% of the liquid particles have a diameter size of 100 microns or less.

10. The atomization device of claim 1 wherein the device is adapted to produce liquid particles having a size between, and including, 20 μm to 350 μm.

11. The atomization device of claim 1 wherein the device is adapted to produce liquid particles having a size between, and including, 20 μm to 100 μm.

12. The atomization device of claim 1 wherein the capillary openings include liquid, wherein a portion of the liquid carried by the filaments is released from the filaments approximately 180 degrees from the contact plate, wherein the approximately 180 degrees is measured along the radial path of the rotating brush.

13. The atomization device of claim 1 wherein the liquid source controls the release of liquid to maintain an amount of liquid in the capillary openings less than a full capacity of the capillary openings.

14. The atomization device of claim 1 wherein the liquid source includes a positive pressure source, wherein the positive pressure maintains an amount of liquid between the top plate and bottom plate.

15. An atomization method comprising:

providing an atomization device, wherein the atomization device includes:

a contact plate including a top plate and a bottom plate, wherein a connection between the top plate and bottom plate define a space, wherein the top plate includes a plurality of capillary openings that extend from a top surface of the top plate to a bottom surface of the top plate, a brush including a plurality of a filaments radiating from an central axis of the rotating brush, and a liquid source in fluid connection with the space, wherein the liquid source is adapted to supply a liquid to the space and the plurality of capillary openings; and rotating the brush in a first radial direction such that the filaments contact the contact plate, wherein the filaments absorb a portion of the liquid from the capillary openings, wherein a portion of the contact plate includes a spirally curved surface with which the filaments contact, wherein the radius decreases along a path following the first radial direction, wherein, as the brush rotates, the filaments flex when in contact with the contact plate and release when contact is broken with the contact plate to project liquid from the filaments.

16. The method of claim 15 wherein the capillary openings include a diameter of 1 mm, wherein the liquid within the capillary opening forms a meniscus, wherein after a filament contacts the liquid within the capillary opening, a height of the meniscus is decreased by between 0.9 mm to 1.5 mm.

17. The method of claim 15 wherein the liquid is projected approximately 180 degrees from the contact plate, wherein the approximately 180 degrees is measured along the radial path of the rotating brush.

18. The method of claim 15 wherein the liquid is projected as liquid particles having a size between, and including, 20 μm to 350 μm.

19. The method of claim 15 wherein when the filament is 1 inch in length and wherein the filament is nylon.

20. The method of claim 15 wherein, when contact is broken with the contact plate, the filament oscillates between a forward bend position and a backwards bend position through a linear position, wherein the filament projects liquid each time the filament is in the forward bend position.

* * * * *